United States Patent [19]

Proga

[11] 4,289,066

[45] Sep. 15, 1981

[54] HYDRAULIC POSITION CONTROL FOR MECHANICAL POWER PRESS SLIDES

[75] Inventor: Norbert J. Proga, Eastlake, Ohio

[73] Assignee: Niagara Machine & Tool Works, Buffalo, N.Y.

[21] Appl. No.: 146,651

[22] Filed: May 5, 1980

[51] Int. Cl.[3] ..... B30B 1/26

[52] U.S. Cl. ..... 100/53; 100/257

[58] Field of Search ..... 100/53, 257; 83/543, 83/530; 74/581, 584, 583, 586

[56] References Cited

U.S. PATENT DOCUMENTS

| | | | |
|---|---|---|---|
| 3,400,625 | 9/1968 | Wrona | 100/257 X |
| 3,662,640 | 5/1972 | Wrona | 100/257 X |
| 4,166,415 | 9/1979 | Spanke | 100/53 |

*Primary Examiner*—Billy J. Wilhite

*Attorney, Agent, or Firm*—Christel, Bean & Linihan

[57] ABSTRACT

A mechanically driven power press has vertical slide mechanism adapted to engage and reciprocate the upper movable element of a die set. Means for adjusting the shut height of said slide including a cylinder secured to said slide and a piston slidable therein and having threaded connection with a portion of said cylinder for shut height adjustment. An hydraulic chamber operable to effect working strokes of said slide. The shut height adjustment has a second threaded portion whereby when said first cylinder is pressurized the threaded parts in engagement with the threaded portion of the piston are forced apart to eliminate thread clearance and lock the shut height adjustment.

3 Claims, 1 Drawing Figure

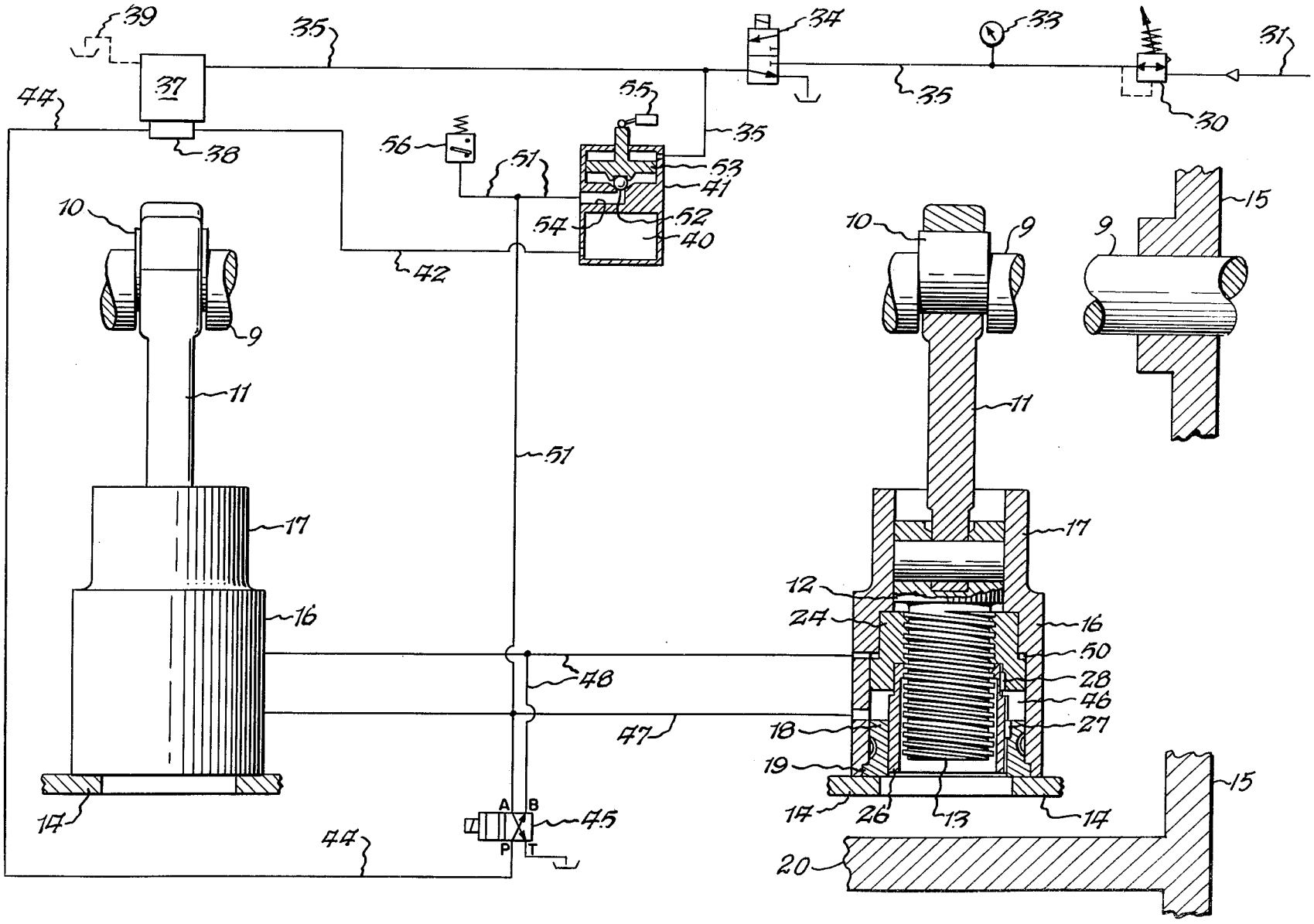
31
30
33
35
34
35
35
39
37
38
44
44
9
10
11
12
13
14
15
16
17
18
19
20
24
26
27
28
40
41
42
46
47
48
50
51
52
53
54
55
56
45
A
B
P
T

HYDRAULIC POSITION CONTROL FOR MECHANICAL POWER PRESS SLIDES

BACKGROUND OF THE INVENTION

This invention relates to mechanical power presses for stamping sheet material and the like and more particularly to the type of power press known in the art as a mechanical press wherein the frame of the press has a base portion for receiving sheet metal stamping or forming dies and the crown of the press has eccentric or crankshaft means for driving a vertically reciprocal slide toward and away from the bed of the press to effect pressing strokes. The slide is supported and guided for such reciprocation by the frame of the press.

Mechanical presses of this type are well known and it is likewise known to provide in conjunction with the vertically reciprocable slide of the press hydraulic overload features which are arranged to shut the press down when predetermined pressing forces are exceeded. This has been accomplished in the prior art by interposing hydraulic means in the slide of the press in such a way that when a given determined hydraulic pressure force is exceeded, the hydraulic protective valves open and operate means for shutting the press down until the malfunction causing the excessive pressing force is corrected. A typical hydraulic means for providing such an overload arrangement is shown in Spanke U.S. Pat. No. 4,166,415 although this general hydraulic overload system has been known and used for many years.

It is also known to provide hydraulic means operable to raise the slide of the press independently of the mechanical drive thereof in order to expose the die on the bed of the press for adjustment or other servicing.

It is known in the prior art of mechanical presses to provide hydraulic means in conjunction with the crown of the press for raising the same to raise the slide of the press and thus expose the die on the bed of the press for purposes similar to herein contemplated. However, use of the hydraulic means in conjunction with the crown of the press is limited to this stated purpose. Examples of die inspection arrangements of this type are shown in Wrona U.S. Pat. No. 3,400,625 and Wrona U.S. Pat. No. 3,662,640. The present invention contemplates self-contained means means acting between the mechanical connection or pitman of the press and the slide of the press in effecting all three of the above stated purposes.

SUMMARY OF THE INVENTION

The principal of the present invention is to provide a mechanical press with an hydraulic arrangement which provides an overload safety device in combination with means for hydraulically raising the slide of the press to expose the die member on the bed of the press without disturbing the shut height adjustment of the slide and also in combination with hydraulic means for locking the threaded connection between the pitman or connection which drives the slide of the press in vertical strokes and the connection thereof with the slide of the press.

Reference will now be had to the hydraulic arrangement provided in the present embodiment of the invention which cooperates with the mechanical drive of the press to provide an overload prevention arrangement. Combined with the hydraulic overload arrangement are means for eliminating thread clearance in the vertical adjustment of the slide.

An important novel feature of the present invention is the provision of an hydraulic arrangement which provides convenient means for raising the slide to give access to the die for servicing or removal of the die without disturbing the shut height adjustment of the slide of the press. A relatively simple air driven hydraulic system is provided for accomplishing all three of the above stated objects.

DESCRIPTION OF THE DRAWING

The single FIGURE of the drawing is a partial front elevational view of the drive portion of a double crank press with the hydraulic pressure operating portions of the press shown schematically in association therewith.

DESCRIPTION OF THE ILLUSTRATED EMBODIMENT

The drawing shows schematically a power press driven mechanically by a conventional eccentric shaft 9 having a pair of eccentrics 10 and a pair of connections 11 which in the illustrated instance are pivoted at their lower ends to a pair of cylindrical head portions 12 of adjusting screws 13. The numeral 14 designates portions of a slide which is guided for vertical movement in the framework 15 of the press for movement toward and away from the usual press bed 20 which is fixed to the press framework 15.

In the interests of simplicity the drawing shows only the portions of the press mechanism which are concerned with the present invention and it is to be understood that the remainder of the press structure is entirely conventional in mechanical double crank presses and the principles of the invention are equally applicable to single crank or other mechanically driven presses.

Referring particularly to the right-hand driving connection of the present embodiment, a hollow cylindrical member 16 known in the art as a barrel is fixed to the slide 14 at its lower end and has an upper end portion 17 of reduced diameter in which the head portion 12 of adjusting screw 13 bears for relative sliding movement.

A worm wheel 18 has a lower flange portion 19 which is engaged between slide 14 and barrel 16 so that the worm wheel is fixed against axial movement relative to the slide 14 and is rotated by a worm journaled in the barrels 16 and engaging both of the worm wheels 18 of the two driving components.

Referring to the right-hand driving connection, a hollow cylindrical member 24 serves as a hydraulic withdrawal and overload piston and is internally threaded to engage the threads of adjusting screw 13. The upper end of member 24 abuts the interior ledge of barrel 16 which occurs at the lower end of reduced portion 17 of barrel 16.

A sleeve member 26 serves as a locking nut. The upper end portion of sleeve member 26 is internally threaded to engage the threads of adjusting screw 13. The sleeve member 26 is keyed to worm wheel 18 as at 27 and is keyed to the piston 24 as at 28 so that the piston 24 rotates jointly with worm wheel 18.

Further reference will be had later herein to the details of operation of the connection adjusting screw and the hydraulic functions performed in connection therewith by the novel hydraulic arrangement herein provided.

In the drawing, the numeral 30 designates a conventional air pressure regulator which controls the pressure of admission of operating air to the system from air supply 31. The degree of air pressure is indicated by a pressure gauge 33. In the drawing, the numeral 34 designates a two-way, normally closed, solenoid operated air valve. The solenoid, therefore, must be energized to activate the air system and in the drawing the solenoid is de-energized so that air pressure from conduit 35 does not enter the system.

The constant air pressure arrangement thus provided supplies hydraulic pressure for operating the present system by means of a Haskel oil pump 37 wherein the regulated air pressure from the line 35 operates to drive an oil pump 38, the air discharging by way of an exhaust 39. The flow of hydraulic fluid under the impetus of the pump is from right to left as viewed in the drawing and the hydraulic fluid to the pump 38 is supplied from a reservoir 40 of a valve assembly 41 which will be described in greater detail further herein. Hydraulic flow from reservoir 40 to pump 38 is by way of a conduit 42.

The output hydraulic pressure from pump 38 is by way of a conduit 44 which leads to an inlet passage of a four-way solenoid operated hydraulic valve designated 45 in the drawing.

It will be noted from the right-hand barrel assembly in the drawing that an annular space 46 between worm wheel 18 and the hollow cylindrical hydraulic withdrawal and overload piston 24 is connected to the source of hydraulic operating pressure by way of a conduit 47. A second cylindrical hydraulic chamber 50 is provided between an outwardly projecting radial face of overload piston 24 and a downwardly facing radial formation of cylindrical member 16 (the barrel member). This hydraulic space is connected to the source of hydraulic pressure by way of a conduit 48 leading from the four-way solenoid valve 45.

The valve assembly 41 is provided to cooperate with the annular chambers 46 of the barrel assemblies of the press to provide overload means for stopping the operation of the press when the hydraulic pressure in chamber 46 exceeds a pre-determined amount which amount is calculated as the maximum tolerable load limit. The pressure developed in the overload chambers 46 is transmitted to a passage 54 of overload valve 41 by means of an extension from conduit 47 designated 51 in the drawing. A ball check valve 52 is normally held seated against hydraulic flow from conduit 51 by air pressure from conduit 35 which acts against a piston 53.

When the tolerable pressure in chambers 46 is exceeded the hydraulic pressure from conduit 51 unseats the ball valve 52 which raises piston 53 and thus trips an overload limit switch 55 and this deactivates the system by cutting off the air supply through solenoid valve 34 which switches the solenoid valve 45 to the illustrated position which allows oil to flow to the reservoir 40 of the overload valve and thus shuts down the press.

In the drawing the numeral 56 designates an hydraulically operated pressure switch which will permit press operation only when the hydraulic system pressure has reached the switch setting.

Referring now to the general operational procedure of the foregoing structure, the four-way solenoid valve 45 which is shown in the de-energized position in the drawing, must be energized to allow oil to flow from the pump 38 through ports P and A of valve 45 to thus fill the lower cavity 46 of the barrel 16. At this time oil is forced out of the upper cavity 50 through ports B and T and returned to the reservoir. To withdraw or open the slide two inches for die inspection or the like, the solenoid of valve 45 is de-energized, oil is supplied through ports P and B to upper cavity 50 and the oil in lower cavity 46 is returned to the reservoir through port A and P of solenoid valve 45.

Also shown in the barrel 16 at the right-hand side of the drawing is the connection screw 13 which is employed to make shut height adjustments. The connection screw 13 has two threaded portions. The upper threaded portion engages the threads in the hydraulic withdrawal and overload piston 24 and the lower threaded portion engages the threads in the threaded lock nut 26. When oil is present in the lower cavity 46 these two parts are forced apart to take up clearances in the threads and thus lock the shut height adjustment mechanism in position.

A typical embodiment of the present invention has been described herein and shown in the accompanying drawing to illustrate the underlying principles of the invention, but it is to be understood that numerous modifications may be made without departing from the broad spirit and scope of the invention.

I claim:

1. A power press comprising frame means including a bed, a reciprocable slide supported by said frame for movement toward and away from said bed, drive means for reciprocating said slide including connecting rod means, overload responsive slide shut height adjusting means acting between said slide and said connecting rod means, said adjusting means including a cylinder on said slide means and a piston slidable therein and pivotally connected with said connecting rod, said piston having threaded connection with a portion of said cylinder for shut height adjustment, an hydraulic withdrawal and overload piston in said slide connected cylinder, a worm wheel at the base of each of said slide means cylinders, an annular hydraulic chamber between the top of each worm wheel and the lower end of each overload piston, and a second hydraulic chamber between an upwardly facing portion of each overload piston and said slide connected cylinder, and valve means alternatively operable to apply hydraulic fluid under predetermined pressure to said first hydraulic cylinder to transmit force from said overload piston to said worm wheel to effect working strokes of of said slide or to apply hydraulic pressure to the space between said overload piston and said slide cylinder to raise the latter to give access to the die on the bed of the press.

2. A power press according to claim 1 wherein said shut height adjustment piston has a second threaded portion in engagement with a locking nut which is engageable at its upper end with said overload piston, whereby when said first hydraulic cylinder is pressurized the threaded parts in engagement with the threaded portion of the piston are forced apart to eliminate thread clearance and lock the shut height adjustment.

3. A power press according to claim 2 wherein said thread locking nut is keyed to said worm wheel and to said overload piston for joint rotation therewith.

* * * * *